US010217415B2

(12) United States Patent
Lin

(10) Patent No.: US 10,217,415 B2
(45) Date of Patent: Feb. 26, 2019

(54) DISPLAY DEVICE AND DRIVING METHOD THEREOF

(71) Applicant: InnoLux Corporation, Miao-Li County (TW)

(72) Inventor: Cheng-Yen Lin, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 0 days.

(21) Appl. No.: 15/590,036

(22) Filed: May 9, 2017

(65) Prior Publication Data

US 2017/0329171 A1 Nov. 16, 2017

(30) Foreign Application Priority Data

May 10, 2016 (CN) ..... 2016 1 0303752

(51) Int. Cl.
*G09G 3/36* (2006.01)
*G09G 3/3258* (2016.01)
*G09G 3/3266* (2016.01)

(52) U.S. Cl.
CPC ..... *G09G 3/3266* (2013.01); *G09G 3/3258* (2013.01); *G09G 3/3607* (2013.01); *G09G 3/3696* (2013.01); *G09G 2300/0439* (2013.01); *G09G 2300/0452* (2013.01); *G09G 2310/0281* (2013.01)

(58) Field of Classification Search
CPC .. G09G 3/3258; G09G 3/3266; G09G 3/3607; G09G 3/3696
USPC ..... 345/55–94, 204–214, 694; 349/39; 348/731, 790; 257/532
See application file for complete search history.

(56) References Cited

U.S. PATENT DOCUMENTS 9,904,065 B2 * 2/2018 Jin ..... G02B 27/2214
9,947,280 B2 * 4/2018 Chen ..... G09G 3/3648
9,989,797 B2 * 6/2018 Kim ..... G02F 1/13338
2006/0018040 A1 * 1/2006 Uchiyama ..... G02B 13/22 359/726
2009/0102777 A1 * 4/2009 Izumikawa ..... G09G 3/3614 345/96
2010/0214461 A1 * 8/2010 Totsuka ..... H04N 1/40056 348/300
2011/0012815 A1 * 1/2011 Tsubata ..... G02F 1/136213 345/55
2012/0133628 A1 * 5/2012 Kim ..... G09G 3/3614 345/208
2013/0222216 A1 * 8/2013 Park ..... G09G 3/3614 345/55

(Continued)

*Primary Examiner* — Prabodh M Dharia
(74) *Attorney, Agent, or Firm* — Bacon & Thomas, PLLC

(57) ABSTRACT

A display device includes a plurality of sub-pixels. The display device displays a specific image composed of display lines. A display line of the specific image is supplied to a portion of the sub-pixels through the data lines to form an arrangement of brightness and darkness with a period of Q×M, and a pixel is composed by Q sub-pixels. The plurality of sub-pixels corresponding to the display line have a polarity distribution with a second period of 2N, and 2N sub-pixels in one period are divided into a first region containing first to N-th sub-pixels and a second region containing (N+1)-th to 2N-th sub-pixels. The polarity distribution of the first to N-th sub-pixels is opposite to that of the (N+1)-th to 2N-th sub-pixels. The least common multiple of M and N is an odd multiple of N.

12 Claims, 7 Drawing Sheets

(56) References Cited

U.S. PATENT DOCUMENTS

| | | | | |
|---|---|---|---|---|
| 2014/0267473 | A1* | 9/2014 | Washio | G09G 3/3688 345/694 |
| 2015/0042238 | A1* | 2/2015 | Chuang | G09G 3/3614 315/291 |
| 2017/0103723 | A1* | 4/2017 | Chen | G09G 3/3677 |
| 2018/0103174 | A1* | 4/2018 | Ito | H04N 1/21 |

* cited by examiner

| M \ N | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|---|---|---|---|---|---|---|---|---|---|---|
| 1 | 3 | 3 | 1 | 3 | 3 | 1 | 3 | 3 | 1 | 3 | 3 | 1 | 3 | 3 | 1 | 3 | 3 | 1 | 3 | 3 | 1 | 3 | 3 | 1 | 3 | 3 | 1 | 3 | 3 | 1 | 3 | 3 |
| 2 | 6 | 3 | 2 | 3 | 6 | 1 | 6 | 3 | 2 | 3 | 6 | 1 | 6 | 3 | 2 | 3 | 6 | 1 | 6 | 3 | 2 | 3 | 6 | 1 | 6 | 3 | 2 | 3 | 6 | 1 | 6 | 3 |
| 3 | 9 | 9 | 3 | 9 | 9 | 3 | 9 | 9 | 1 | 9 | 9 | 3 | 9 | 9 | 3 | 9 | 9 | 1 | 9 | 9 | 3 | 9 | 9 | 3 | 9 | 9 | 1 | 9 | 9 | 3 | 9 | 9 |
| 4 | 12 | 6 | 4 | 3 | 12 | 2 | 12 | 3 | 4 | 6 | 12 | 1 | 12 | 6 | 4 | 3 | 12 | 2 | 12 | 3 | 4 | 6 | 12 | 1 | 12 | 6 | 4 | 3 | 12 | 2 | 12 | 3 |
| 5 | 15 | 15 | 5 | 15 | 3 | 5 | 15 | 15 | 5 | 3 | 15 | 5 | 15 | 15 | 1 | 15 | 15 | 5 | 15 | 3 | 5 | 15 | 15 | 5 | 3 | 15 | 5 | 15 | 15 | 1 | 15 | 15 |
| 6 | 18 | 9 | 6 | 9 | 18 | 3 | 18 | 9 | 2 | 9 | 18 | 3 | 18 | 9 | 6 | 9 | 18 | 1 | 18 | 9 | 6 | 9 | 18 | 3 | 18 | 9 | 2 | 9 | 18 | 3 | 18 | 9 |
| 7 | 21 | 21 | 7 | 21 | 21 | 7 | 3 | 21 | 7 | 21 | 21 | 7 | 21 | 3 | 7 | 21 | 21 | 7 | 21 | 21 | 1 | 21 | 21 | 7 | 21 | 21 | 7 | 3 | 21 | 7 | 21 | 21 |
| 8 | 24 | 12 | 8 | 6 | 24 | 4 | 24 | 3 | 8 | 12 | 24 | 2 | 24 | 12 | 8 | 3 | 24 | 4 | 24 | 6 | 8 | 12 | 24 | 1 | 24 | 12 | 8 | 6 | 24 | 4 | 24 | 3 |
| 9 | 27 | 27 | 9 | 27 | 27 | 9 | 27 | 27 | 3 | 27 | 27 | 9 | 27 | 27 | 9 | 27 | 27 | 3 | 27 | 27 | 9 | 27 | 27 | 9 | 27 | 27 | 1 | 27 | 27 | 9 | 27 | 27 |
| 10 | 30 | 15 | 10 | 15 | 6 | 5 | 30 | 15 | 10 | 3 | 30 | 5 | 30 | 15 | 2 | 15 | 30 | 5 | 30 | 3 | 10 | 15 | 30 | 5 | 6 | 15 | 10 | 15 | 30 | 1 | 30 | 15 |
| 11 | 33 | 33 | 11 | 33 | 33 | 11 | 33 | 33 | 11 | 33 | 3 | 11 | 33 | 33 | 11 | 33 | 33 | 11 | 33 | 33 | 11 | 3 | 33 | 11 | 33 | 33 | 11 | 33 | 33 | 11 | 33 | 33 |
| 12 | 36 | 18 | 12 | 9 | 36 | 6 | 36 | 9 | 4 | 18 | 36 | 3 | 36 | 18 | 12 | 9 | 36 | 2 | 36 | 9 | 12 | 18 | 36 | 3 | 36 | 18 | 4 | 9 | 36 | 6 | 36 | 9 |
| 13 | 39 | 39 | 13 | 39 | 39 | 13 | 39 | 39 | 13 | 39 | 39 | 13 | 3 | 39 | 13 | 39 | 39 | 13 | 39 | 39 | 13 | 39 | 39 | 13 | 39 | 3 | 13 | 39 | 39 | 13 | 39 | 39 |
| 14 | 42 | 21 | 14 | 21 | 42 | 7 | 6 | 21 | 14 | 21 | 42 | 7 | 42 | 3 | 14 | 21 | 42 | 7 | 42 | 21 | 2 | 21 | 42 | 7 | 42 | 21 | 14 | 3 | 42 | 7 | 42 | 21 |
| 15 | 45 | 45 | 15 | 45 | 9 | 15 | 45 | 45 | 5 | 9 | 45 | 15 | 45 | 45 | 3 | 45 | 45 | 5 | 45 | 9 | 15 | 45 | 45 | 15 | 9 | 45 | 5 | 45 | 45 | 3 | 45 | 45 |
| 16 | 48 | 24 | 16 | 12 | 48 | 8 | 48 | 6 | 16 | 24 | 48 | 4 | 48 | 24 | 16 | 3 | 48 | 8 | 48 | 12 | 16 | 24 | 48 | 2 | 48 | 24 | 16 | 12 | 48 | 8 | 48 | 3 |
| 17 | 51 | 51 | 17 | 51 | 51 | 17 | 51 | 51 | 17 | 51 | 51 | 17 | 51 | 51 | 17 | 51 | 3 | 17 | 51 | 51 | 17 | 51 | 51 | 17 | 51 | 51 | 17 | 51 | 51 | 17 | 51 | 51 |
| 18 | 54 | 27 | 18 | 27 | 54 | 9 | 54 | 27 | 6 | 27 | 54 | 9 | 54 | 27 | 18 | 27 | 54 | 3 | 54 | 27 | 18 | 27 | 54 | 9 | 54 | 27 | 2 | 27 | 54 | 9 | 54 | 27 |
| 19 | 57 | 57 | 19 | 57 | 57 | 19 | 57 | 57 | 19 | 57 | 57 | 19 | 57 | 57 | 19 | 57 | 57 | 19 | 3 | 57 | 19 | 57 | 57 | 19 | 57 | 57 | 19 | 57 | 57 | 19 | 57 | 57 |
| 20 | 60 | 30 | 20 | 15 | 12 | 10 | 60 | 15 | 20 | 6 | 60 | 5 | 60 | 30 | 4 | 15 | 60 | 10 | 60 | 3 | 20 | 30 | 60 | 5 | 12 | 30 | 20 | 15 | 60 | 2 | 60 | 15 |
| 21 | 63 | 63 | 21 | 63 | 63 | 21 | 9 | 63 | 7 | 63 | 63 | 21 | 63 | 9 | 21 | 63 | 63 | 7 | 63 | 63 | 3 | 63 | 63 | 21 | 63 | 63 | 7 | 9 | 63 | 21 | 63 | 63 |
| 22 | 66 | 33 | 22 | 33 | 66 | 11 | 66 | 33 | 22 | 33 | 6 | 11 | 66 | 33 | 22 | 33 | 66 | 11 | 66 | 33 | 22 | 3 | 66 | 11 | 66 | 33 | 22 | 33 | 66 | 11 | 66 | 33 |
| 23 | 69 | 69 | 23 | 69 | 69 | 23 | 69 | 69 | 23 | 69 | 69 | 23 | 69 | 69 | 23 | 69 | 69 | 23 | 69 | 69 | 23 | 69 | 3 | 23 | 69 | 69 | 23 | 69 | 69 | 23 | 69 | 69 |
| 24 | 72 | 36 | 24 | 18 | 72 | 12 | 72 | 9 | 8 | 36 | 72 | 6 | 72 | 36 | 24 | 9 | 72 | 4 | 72 | 18 | 24 | 36 | 72 | 3 | 72 | 36 | 8 | 18 | 72 | 12 | 72 | 9 |
| 25 | 75 | 75 | 25 | 75 | 15 | 25 | 75 | 75 | 25 | 15 | 75 | 25 | 75 | 75 | 5 | 75 | 75 | 25 | 75 | 15 | 25 | 75 | 75 | 25 | 3 | 75 | 25 | 75 | 75 | 5 | 75 | 75 |
| 26 | 78 | 39 | 26 | 39 | 78 | 13 | 78 | 39 | 26 | 39 | 78 | 13 | 6 | 39 | 26 | 39 | 78 | 13 | 78 | 39 | 26 | 39 | 78 | 13 | 78 | 3 | 26 | 39 | 78 | 13 | 78 | 39 |
| 27 | 81 | 81 | 27 | 81 | 81 | 27 | 81 | 81 | 9 | 81 | 81 | 27 | 81 | 81 | 27 | 81 | 81 | 9 | 81 | 81 | 27 | 81 | 81 | 27 | 81 | 81 | 3 | 81 | 81 | 27 | 81 | 81 |
| 28 | 84 | 42 | 28 | 21 | 84 | 14 | 12 | 21 | 28 | 42 | 84 | 7 | 84 | 6 | 28 | 21 | 84 | 14 | 84 | 21 | 4 | 42 | 84 | 7 | 84 | 42 | 28 | 3 | 84 | 14 | 84 | 21 |
| 29 | 87 | 87 | 29 | 87 | 87 | 29 | 87 | 87 | 29 | 87 | 87 | 29 | 87 | 87 | 29 | 87 | 87 | 29 | 87 | 87 | 29 | 87 | 87 | 29 | 87 | 87 | 29 | 87 | 3 | 29 | 87 | 87 |
| 30 | 90 | 45 | 30 | 45 | 18 | 15 | 90 | 45 | 10 | 9 | 90 | 15 | 90 | 45 | 6 | 45 | 90 | 5 | 90 | 9 | 30 | 45 | 90 | 15 | 18 | 45 | 10 | 45 | 90 | 3 | 90 | 45 |
| 31 | 93 | 93 | 31 | 93 | 93 | 31 | 93 | 93 | 31 | 93 | 93 | 31 | 93 | 93 | 31 | 93 | 93 | 31 | 93 | 93 | 31 | 93 | 93 | 31 | 93 | 93 | 31 | 93 | 93 | 31 | 3 | 93 |
| 32 | 96 | 48 | 32 | 24 | 96 | 16 | 96 | 12 | 32 | 48 | 96 | 8 | 96 | 48 | 32 | 6 | 96 | 16 | 96 | 24 | 32 | 48 | 96 | 4 | 96 | 48 | 32 | 24 | 96 | 16 | 96 | 3 |

FIG. 5

DISPLAY DEVICE AND DRIVING METHOD THEREOF

BACKGROUND OF THE INVENTION

1. Field of the Disclosure

The present disclosure relates to a display device and, more particularly, to a display device for reducing crosstalk or flicker, and a driving method thereof.

2. Description of Related Art

In order to avoid degrading the characteristic of liquid crystal molecules in a display device and thus decreasing the lifetime of the liquid crystal molecules, the driving voltage of the display device must proceed with voltage polarity inversion periodically. The driving method for the AC voltage of alternating the positive polarity and the negative polarity with respect to the common electrode is known as "inversion method". The driving voltages of the positive polarity and the negative polarity are relative to the voltage of the common electrode. Therefore, only if the voltage of the common electrode in the display device is time-invariant, the image can be displayed normally.

However, when turning on/off a thin film transistor, the voltage variations of the scan line and the data line will be coupled to the common electrode, resulting in shifting the voltage of the common electrode and causing crosstalk and flicker. FIG. 1 is a schematic diagram illustrating the voltage of a normal common electrode and an abnormal common electrode. As shown in FIG. 1, normally, the voltage of the common electrode is 3 V, the voltage of the positive polarity is 5 V, and the voltage of the negative polarity is 1 V. The voltage difference between the positive polarity and the common electrode is 2 V, and the voltage difference between the negative polarity and the common electrode is 2 V. For example, when the voltage of the common electrode shifts to 3.5 V, the voltage difference between the positive polarity and the common electrode is 1.5 V, and the voltage difference between the negative polarity and the common electrode is 2.5 V. Thus, when driving liquid crystal molecules with a positive polarity of 1.5 V and a negative polarity of 2.5 V, respectively, the liquid crystal molecules of the pixel show different luminance and colors because rotation angles of the liquid crystal molecules are different. Therefore, crosstalk or flicker might occur in certain specific images. The specifications of crosstalk or flicker are defined by a series of specific images, wherein the pixels are periodically arranged with interlaced brightness and darkness in rows or columns.

Generally, a capacitance exists among the common electrode, the data line and the sub-pixel electrode. However, the capacitance may not induce the voltage variation of the common electrode by capacitance coupling. For example, when the data line and the sub-pixel electrode are of DC voltage and time-invariant, the voltage of the common electrode does not vary. However, during the display operation, the voltages of the data line and the sub-pixel electrode are time-variant.

During the process of charging a row of sub-pixels, based on the driving schemes, a data line provides bright-state voltages of the positive polarity or the negative polarity to the bright-state sub-pixels, and also provides the voltage of the common electrode to the dark-state sub-pixels. Comparing the voltages of data lines in the row and in the next row, some increase, some decrease and some unchanged. As the sub-pixel electrodes receive the bright-state voltages of the positive polarity or the negative polarity, the voltages of the polarity of the sub-pixel electrodes change from negative to positive, or from positive to negative, while, the voltages of the dark-state sub-pixels will remain unchanged. The number of the data lines with increased voltage or the number of the sub-pixel electrodes with increased voltage, together with the voltage variation rates thereof and the value of the capacitance with respect to the common electrode, will constitute a positive coupling current. The number of the data lines with decreased voltage or the number of the sub-pixel electrodes with decreased voltage, together with the voltage variation rates thereof and the value of the capacitance with respect to the common electrode, will constitute a negative coupling current. If the positive coupling current cannot balanced the negative coupling current, the voltage of the common electrode will vary positively or negatively, resulting in crosstalk or flicker phenomenon. For example, in FIG. 1, in an abnormal condition, the voltage of the common electrode varies from 3 V to 15 V. and this causes the sub-pixels of positive polarity and negative polarity to show different luminance and colors. Therefore, it is desired for the prior display device and driving method to be improved.

SUMMARY OF THE INVENTION

The main propose of the present disclosure is to provide a display device and driving method thereof. By considering the period of sub-pixels through the data lines to form an arrangement of brightness and darkness in specific images and the period of the arrangement of the polarity of the data lines in a driving scheme, the display device and driving method thereof can display the image normally by balancing the positively and negatively coupled currents.

According to a feature of the present disclosure, there is provided a display device, which comprises: a plurality of data lines; a plurality of scan lines; a plurality of sub-pixels disposed between the data lines and the scan lines, respectively, wherein the display device displays a specific image, the specific image includes a display line, the display line is supplied to a portion of the sub-pixels through the data lines to form an arrangement of brightness and darkness with a first period of Q×M, and Q and M are positive integers. For example, when a pixel is composed of three RCB (red, green and blue) sub-pixels and the display line is supplied to the sub-pixels through the data lines to form an arrangement of brightness and darkness with a period of 3×M, wherein the sub-pixels corresponding to the display line have a polarity distribution with a second period of 2N, N is a positive integer, 2N sub-pixels in one period are divided into a first region containing first to N-th sub-pixels and a second region containing (N+1)-th to 2N-th sub-pixels, a polarity distribution of the sub-pixels in the first region is opposite to a polarity distribution of the sub-pixels in the second region, and a least common multiple of Q×M and N is an odd multiple of N.

BRIEF DESCRIPTION OF THE DRAWINGS

FIG. 5 is a schematic diagram illustrating the relation of M and N in the present disclosure;

DETAILED DESCRIPTION OF THE PREFERRED EMBODIMENT

Figure 1:
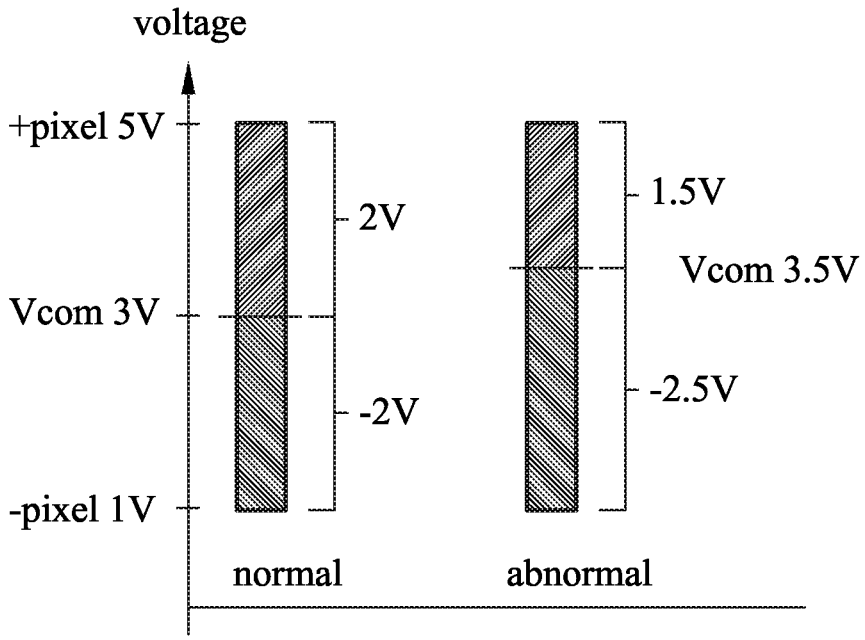
FIG. 1 (PRIOR ART)
FIG. 1 is a schematic diagram illustrating the voltage of a prior common electrode.
Figure 2:
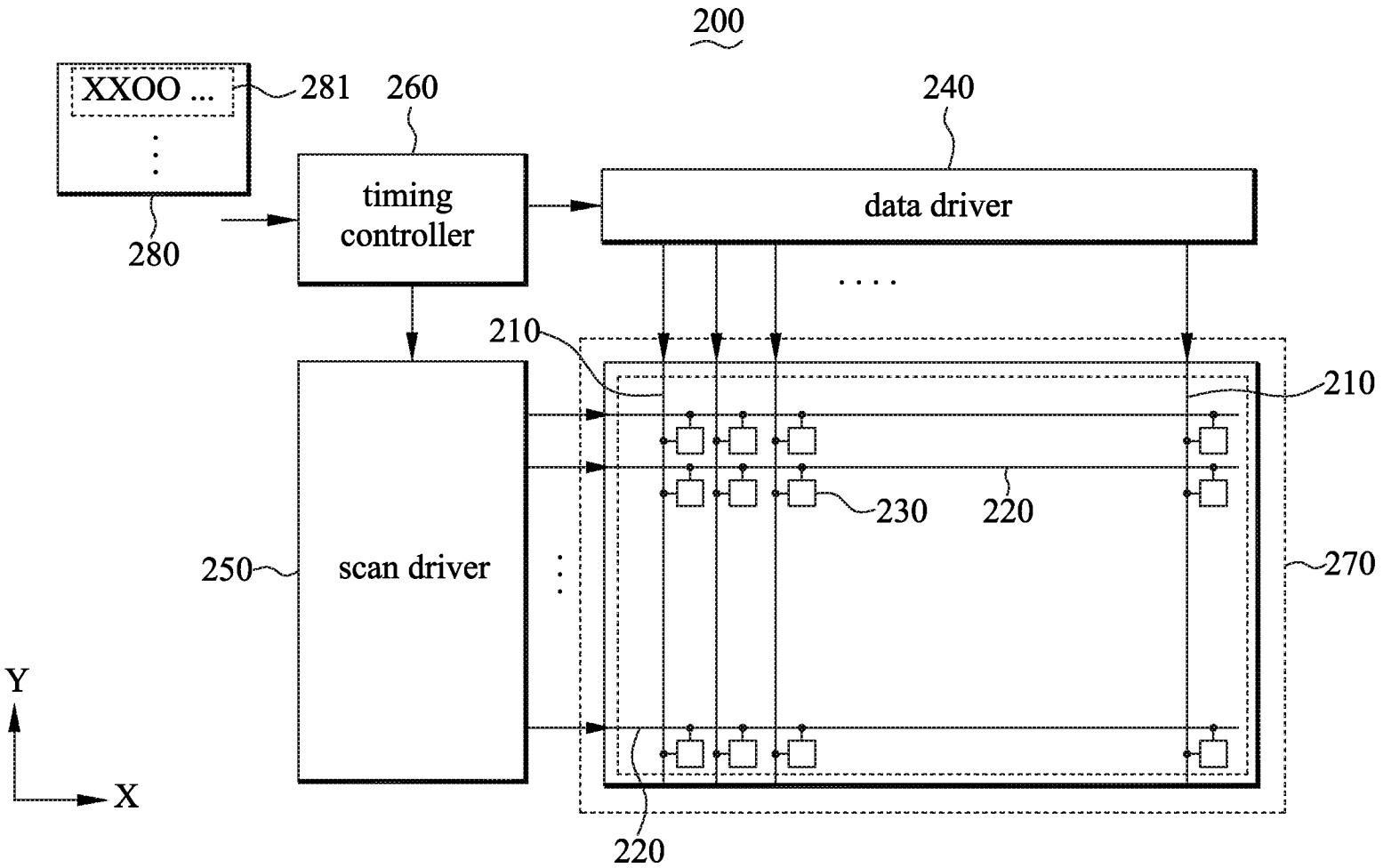
FIG. 2 is a schematic diagram of a display device according to the present disclosure.

FIG. 2 is a schematic diagram illustrating a display device 200 according to the present disclosure. As shown in FIG. 2, the display device 200 comprises a plurality of data lines 210, a plurality of scan lines 220, a plurality of sub-pixels 230, a data driver 240, a scan driver 250, a timing controller 260, and a common voltage layer 270. The display device displays a specific image, the specific image includes a plurality of display lines, one of the display lines is supplied to a row of the sub-pixels through the data lines to form an arrangement of brightness and darkness with a period of Q×M, and Q and M are positive integers. M pixels form a period, and one pixel is composed of Q sub-pixels. The display device 200 is a liquid crystal display device, wherein as known by the person skilled in the art, a pixel is composed of three RCSB (red, green and blue) sub-pixels 230. In this embodiment, Q is 3, while, in other embodiments, Q can be a positive integer other than 3.

The data lines 210 are arranged along a first direction (Y-axis). The scan lines 220 are arranged along a second direction (X-axis). The sub-pixels 230 are disposed between the data lines 210 and the scan lines 220, for displaying the display lines 281, wherein the first direction is substantially perpendicular to the second direction.

The data driver 240 is connected to the plurality of data lines 210 for writing data signals of a display line 281 of the specific image 280 to the corresponding plurality of sub-pixels 230. The scan driver 250 is connected to the plurality of scan lines 220 for enabling the corresponding plurality of sub-pixels 230, so as to allow the data driver 240 to write data of a display line 281 of the specific image 280 to the corresponding sub-pixels 230.

The timing controller 260 is connected to the data driver 240 and the scan driver 250 for providing timing to the data driver 240 and the scan driver 250. The common voltage layer 270 corresponds to the plurality of sub-pixels 230 for providing a common voltage (Vcom) to the plurality of sub-pixels 230.

In order to reduce crosstalk or flicker, in the present disclosure, the sub-pixels 230 corresponding to the display line 281 has a polarity distribution with a period of 2N, where N is a positive integer, and 2N sub-pixels 230 within one period are divided into a first region (Region A) containing first to N-th sub-pixels 230 and a second region (Region B) containing (N+1)-th to 2N-th sub-pixels 230. The polarity distribution of the sub-pixels 230 in the first region (Region A) is opposite to the polarity distribution of the sub-pixels 230 in the second region (Region B), wherein the least common multiple of 3×M and N is an odd multiple of N.

Figure 3:
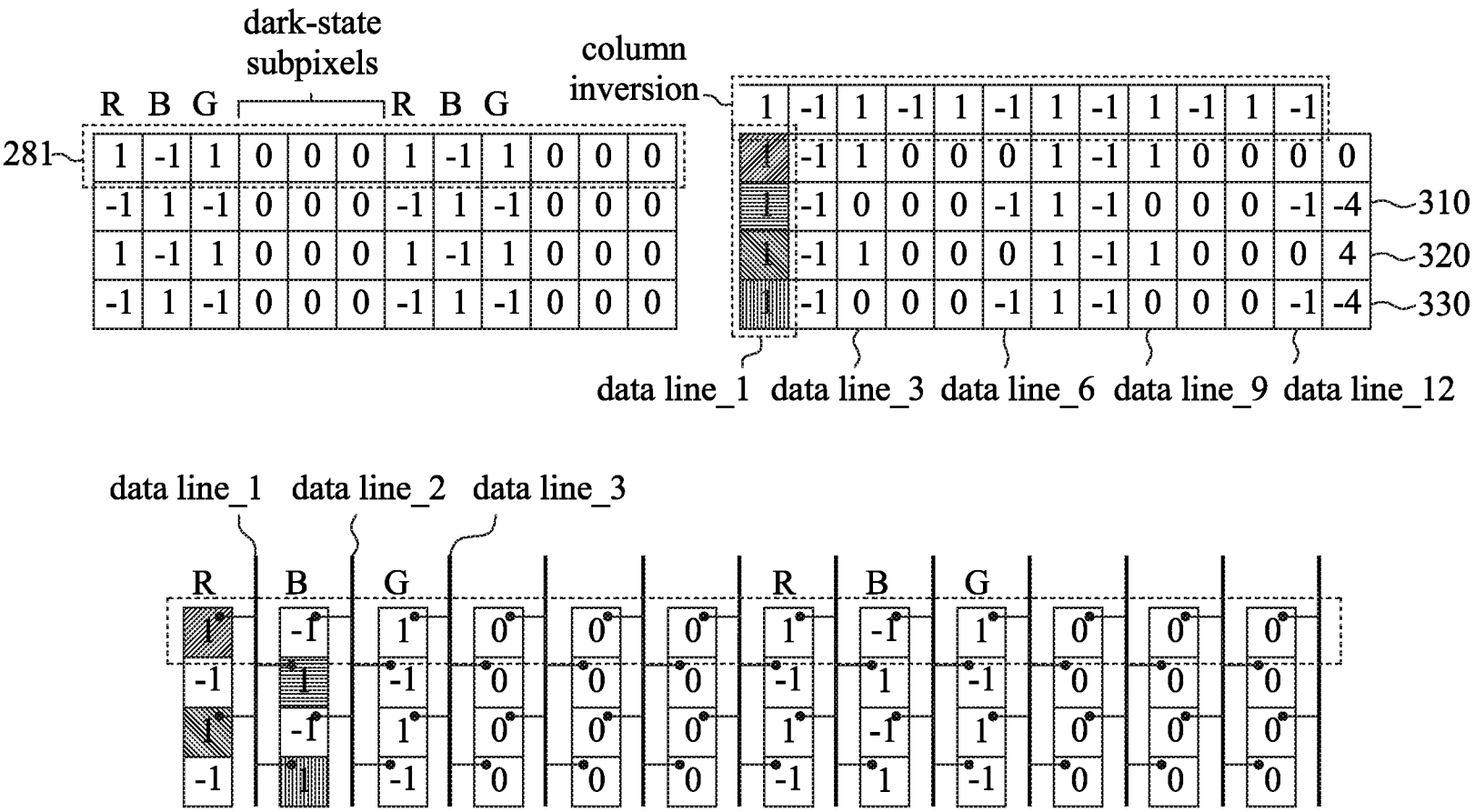
FIG. 3 is a schematic diagram illustrating the polarities of four display lines, the corresponding sub-pixels and the data line.

To describe the effect of the present disclosure of reducing crosstalk or flicker, FIG. 3 schematically illustrates a plurality of display lines and the polarity of the corresponding sub-pixels as well as the polarity of the corresponding data lines. As shown in FIG. 3, there are four pixels of four display lines 281 and, that is, 12 sub-pixels. The first and third sub-pixels corresponding to data line_1 are disposed at left side of the data line_1, the second and fourth sub-pixels corresponding to data line_1 are disposed at right side of the data line_1, and the way of arrangement is called flip pixel design. The polarity of the specific image 210 is column inversion. The data line 210 gives voltage 1 or −1 to the bright-state sub-pixels by column inversion, and gives a voltage 0 to the dark-state sub-pixels. As shown in FIG. 3, in the four rows, the voltage of the data line_3 varies in order as 1→0→1→0. The voltage of the data line_6 varies in order as 0→−1→0→−1. The voltage of the data line_9 varies in order as 1→0→1→0. The voltage of the data line_12 varies in order as 0→−1→0→−1. The voltage varying as 0→1 or −1→0 means that the voltage increases. The voltage varying as 1→0 or 0→−1 means that the voltage decreases. The voltage varying as 0→0, 1→1 or −1→−1 means that the voltage remains unchanged. In FIG. 3, numeral 310 represents the statistics of the voltage variations of the data lines between the second row and the first row, numeral 320 represents the statistics of the voltage variations of the data lines between the third row and the second row, numeral 330 represents the statistics of the voltage variations of the data lines between the fourth row and the third row, and so on. For numeral 310, compared to the previous row, eight voltages remain unchanged, but four voltages decrease as 1 to 0 or 0 to −1. This is marked as −4 in FIG. 3 to represent more negatively coupled current, which cannot be balanced by the positively coupled current. Therefore, the voltage of the common electrode 270 varies negatively. For numeral 320, compared to the previous row, eight voltages remain unchanged, but four voltages increase as 0 to 1 or −1 to 0. This is marked as +4 in FIG. 3 to represent more positively coupled current, which cannot be balanced by the negatively coupled current. Therefore, the voltage of the common electrode 270 varies positively, and so on.

From FIG. 3, it is known that whether a purely coupled current exists depends on whether the period of the arrangement of the polarity of the data lines in a driving scheme matches the period of the arrangement of the brightness and the darkness of the pixels in a specific image. It is called a short-distance balance when considering only the period of the data line 210. In FIG. 3, the driving scheme matched with polarity of the specific image is column inversion, where the polarity of the data line is arranged as "+−+− . . . ", that is, the period of the polarity of the data line is 2. Another driving scheme is 2-column inversion, where polarity of the data line is arranged as "++−−++−− . . . ", that is, the polarity of data line is 4. In a short-distance region with a period of 2 or a period of 4, the positively and negatively coupled current cannot be balanced by each other, and most of the purely coupled current is of the same polarity and cannot be long-distance balanced. Even, after a long-distance superposition, the voltage of the common voltage layer is greatly shifted, and thus undesired crosstalk or flicker became more serious.

Figure 4:
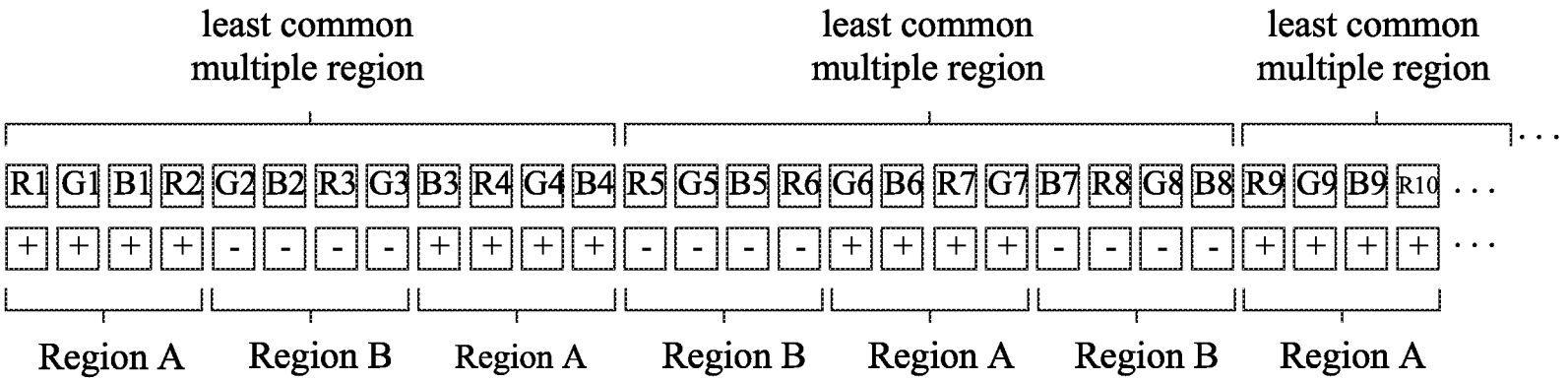
FIG. 4 is a schematic diagram illustrating the polarity distribution of the sub-pixels corresponding to a display line of the present disclosure.

FIG. 4 is a schematic diagram illustrating the polarity distribution of the sub-pixels 230 corresponding to a display line 281 of the present disclosure. The present disclosure considers a long-distance balance, with which a plurality of M and N's least common multiple regions can be balanced. Therefore, in the present disclosure, the sub-pixels are divided into a plurality of least common multiple regions according to M and N, and the least common multiple region has P sub-pixels, where P is the least common multiple of 3×M and N. In the least common multiple region, the total number of first regions (Region A) and second regions (Region B) is L, wherein L is an odd number, and N satisfies the following equation:

$$L=LCM(3\times M,N)/N$$

where L is an odd number, and LCM( ) represents the least common multiple operation.

A shown in FIG. 4, in this case, M is 4 and N is 4. For M is 4, a display line 281 of the specific image 280 is supplied to a portion of the sub-pixels through data lines to form an arrangement of brightness and darkness with a period of M, that is, every 12 sub-pixels 230 display through the data lines to form an arrangement of brightness and darkness, or every 12 sub-pixels 230 display the same image. For N is 4, 8(=2×4) sub-pixel 230 are in one period, wherein the 1st to the 4th sub-pixels 230 are in the first region (Region A), and the 5th to the 8th sub-pixels 230 are in the second region (Region B). As shown in FIG. 4, the polarity distribution of the sub-pixels in the first region (Region A) is "++++", and the polarity distribution of sub-pixels in the second region (Region B) is "−−−−". That is, the polarity distribution of the sub-pixels in the first region is opposite to the polarity distribution of the sub-pixels in the second region. In other embodiments, the polarity distribution of sub-pixels in first region (Region A) is "+−−+", and the polarity distribution of sub-pixels in the second region (Region B) is "−++−".

Since LCM(12, 4)=12, we have P=12. Therefore, a least common multiple region has 12 sub-pixels 230. Since 12=3×4=3N, we have L=3, which satisfies the requirement of an odd number. That is, in a least common multiple region, the total number of the first regions and the second regions is 3. As shown in FIG. 4, the least common multiple region contains two first regions (Region A) and one second region (Region B). While, the next least common multiple region contains one first region (Region A) and two second regions (Region B). The polarity of the 12 sub-pixels in the least common multiple region is opposite to the polarity of the 12 sub-pixels in the next least common multiple region.

In the present disclosure, suppose that a least common multiple region employs a driving scheme of odd multiple of N. For example, for L=1, a least common multiple region employs Region A, and a next least common multiple region employs Region B. For L=3, a least common multiple region employs Region A, Region B, Region A, and a next least common multiple region employs Region B, Region A, Region B. That is, two adjacent least common multiple regions employ a driving scheme with opposite polarities. If the coupled currents cannot be balanced in one least common multiple region, the coupled currents can be long-distance balanced in two adjacent least common multiple regions, since two adjacent least common multiple regions employ a driving scheme with opposite polarities that will induce coupled currents with the same amount but opposite polarities.

Suppose that a least common multiple region employs a driving scheme of even multiple of N. For example, for multiple of 2 (L=2), there are Region A, Region B, or multiple of 4 (L=4), there are Region A, Region B, Region A, Region B, and so on. If the coupled current cannot be balanced in a least common multiple region, a coupled current of the same polarity occurs in an adjacent image region due to a driving scheme of the same polarity. Accordingly, there is a superposition due to the least common multiple regions, which causes the voltage of the common voltage layer to shift, resulting in an abnormal image. Moreover, the higher the resolution, the worse the situation, due to more purely coupled current contributed by more least common multiple regions in the display.

FIG. 5 is a schematic diagram illustrating the relation of M and N in the present disclosure. As shown in FIG. 5, the values of L for M=1 to 32 and N=1 to 32 are listed. In FIG. 5, for the numbers with oblique lines, a long-distance balance is unavailable. After deriving the value of the related M for a display line 281 of a specific image 280, it is able to select a value of the related N according to FIG. 5, and the data driver 240 can produce the related polarity to drive the related data line 210, so as to set the polarity of the related sub-pixel 230.

Figure 6:
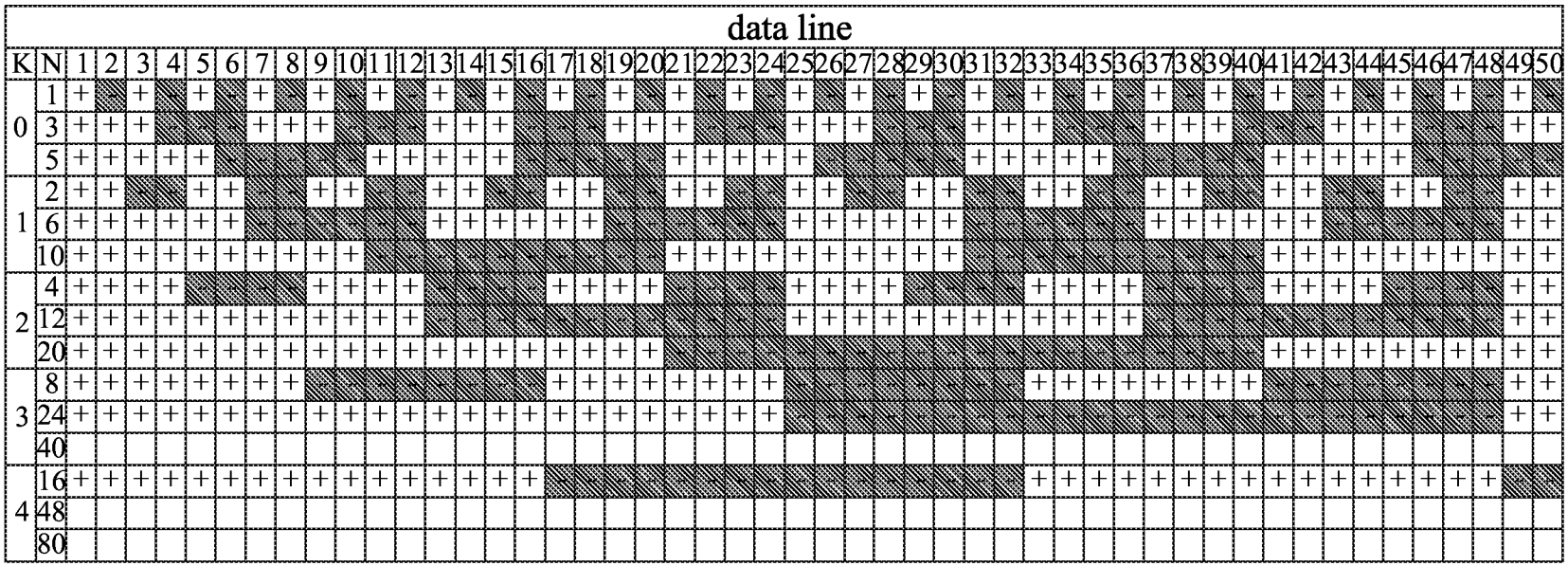
FIG. 6 is a schematic diagram illustrating the relation of K and N in the present disclosure.

FIG. 6 is a schematic diagram illustrating the relation of K and N of the present disclosure. As shown in FIG. 6, for the numbers without oblique lines, that is, where L is an odd number, the relation of M and N is that N is an odd number×$2^K$, where K is a non-negative integer, such that the displayed pixels for $1\leq M<2^{K+1}$ are long-distance balanced. However, the displayed pixels for $M=2^{K+1}$ can be long-distance superposed rather than long-distance balanced. For example, in FIG. 6, K is 4 and N is an odd number multiplied by 24, such as $N=16=1\times16=1\times2^4$, or $N=48=3\times16=3\times2^4$, so that the pixels with period M smaller than $2^5$ (that is, 1 to 31) can be long-distance balanced. The displayed pixels for $1\leq M<2^{K+1}$ can be long-distance balanced with increasing K or N. With increasing K or N, the period M is also increased, wherein M is for the pixels unable to be long-distance balanced, the number of the first regions (Region A) and the second regions (Region B) in the region where the number of the pixels equal to the M and N's least common multiple in the display will be less, and the purely coupled current in the first region (Region A) and the second region (Region B) will be small as well. Therefore, the long-distance superposed purely coupled current greatly reduces. This helps the voltage of the common voltage layer 270 to be stable.

Figure 7:
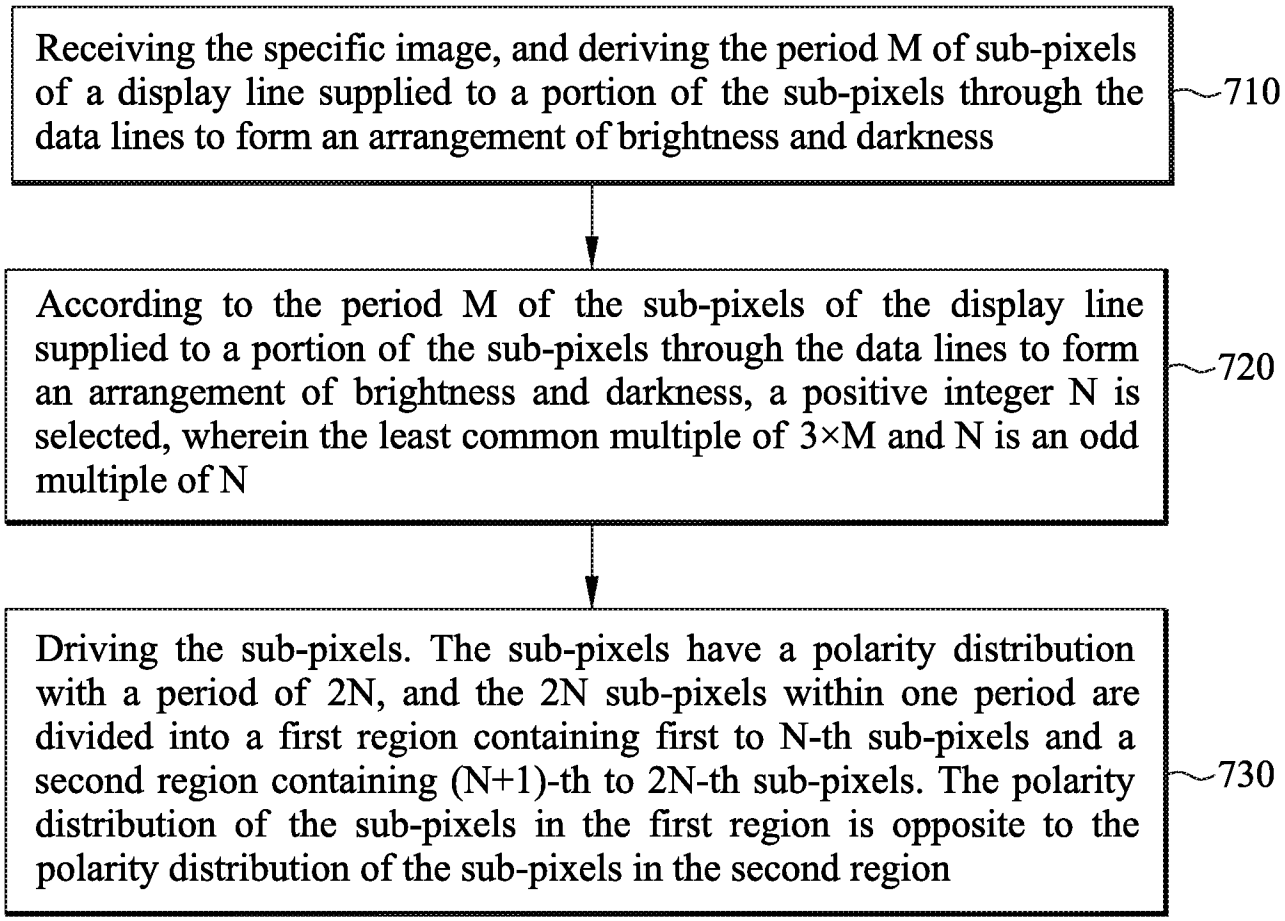
FIG. 7 is the flow chart of a driving method according to the present disclosure.

FIG. 7 is the flow chart of a driving method according to the present disclosure, which is applied to the display device 200 as shown in FIG. 2. Please refer to FIGS. 2 and 7 together. In the driving method, step 710 is executed to receive the specific image 280, and derive the period M of sub-pixels of a display line supplied to a portion of the sub-pixels through the data lines to form an arrangement of brightness and darkness. In step 720, according to the period M of the sub-pixels of the display line supplied to a portion of the sub-pixels through the data lines to form an arrangement of brightness and darkness, a positive integer N is selected, wherein the least common multiple of 3×M and N is an odd multiple of N. Step 730 is executed to drive the sub-pixels 230. The sub-pixels 230 have a polarity distribution with a period of 2N, and the 2N sub-pixels 230 within one period are divided into a first region containing first to N-th sub-pixels 230 and a second region containing (N+1)-th to 2N-th sub-pixels 230. The polarity distribution of the sub-pixels 230 in the first region is opposite to the polarity distribution of the sub-pixels 230 in the second region.

As described for the display device 200 of the present disclosure, the driving method provided by the present disclosure considers the period of sub-pixels through the data lines to form an arrangement of brightness and darkness in specific images and the period of the arrangement of the polarity of the data lines in a driving scheme, so as to effectively balance the positively and negatively coupled currents, thereby displaying the image normally.

From the aforementioned description, the present disclosure provides a technology for the period of the displayed pixels of a specific image to match the period of the arrangement of the polarity of the data lines. With respect to various kinds of specific image, it can balance the positively and negatively coupled currents caused by the data line and the electrodes of the sub-pixels 230, so as to reduce or eliminate them. That is, the voltage of the electrodes of the common voltage layer 270 can be time-invariant, so as to display the image normally.

The aforementioned embodiments are examples for description. The scope of the present disclosure is claimed as in the claims and is not limited to the aforementioned embodiments.

What is claimed is:

1. A display device, comprising:

a plurality of data lines; and a plurality of pixels, at least one of the plurality of pixels composed of Q sub-pixels, wherein the display device displays a specific image, the specific image includes a display line, the display line is supplied to a portion of the sub-pixels through the data lines to form an arrangement of brightness and darkness with a first period of Q×M, and Q and M are positive integers;

wherein the sub-pixels corresponding to the display line have a polarity distribution with a second period of 2N, N is a positive integer, 2N sub-pixels in one of the second period are divided into a first region containing first to N-th sub-pixels and a second region containing (N+1)-th to 2N-th sub-pixels, a polarity distribution of the portion of the sub-pixels in the first region is opposite to a polarity distribution of the portion of the sub-pixels in the second region, and a least common multiple of Q×M and N is an odd multiple of N.

2. The display device as claimed in claim 1, wherein, in a least common multiple region, a total number of the first regions and the second regions is L, and N satisfies:

$$L=LCM(Q\times M,N)/N$$

where L is an odd number, and LCM( ) represents a least common multiple operation.

3. The display device as claimed in claim 1, further comprising:

a data driver connected to the plurality of data lines for writing data of the display line of the specific image to the portion of the sub-pixels;

a scan driver connected to a plurality of scan lines for enabling the portion of the sub-pixels;

a timing controller connected to the data driver and the scan driver for providing timing to the data driver and the scan driver.

4. The display device as claimed in claim 2, wherein a polarity of P sub-pixels in the least common multiple region is opposite to a polarity of P sub-pixels in an adjacent least common multiple region.

5. The display device as claimed in claim 1, wherein the display device is a liquid crystal display device.

6. The display device as claimed in claim 1, wherein the plurality of pixels for $1\leq M<2^{K+1}$ are long-distance balanced, where K is a non-negative integer.

7. A driving method for a display device comprising a plurality of data lines, a plurality of scan lines and a plurality of sub-pixels, at least one of the plurality of sub-pixels being arranged at each intersection of data lines and scan lines, wherein the display device displays a specific image, the specific image includes a display line, the display line is supplied to a portion of the sub-pixels through the data lines to form an arrangement of brightness and darkness with a first period of Q×M, and Q and M are positive integers, the driving method comprising:

receiving the specific image and deriving a period of the arrangement of brightness and the darkness of the portion of the sub-pixels of displayed pixels;

selecting a positive integer N according to the first period of the arrangement of brightness and the darkness of the portion of the sub-pixels of the displayed pixels, wherein a least common multiple of Q×M and N is an odd multiple of N; and driving the portion of the sub-pixels, the portion of the sub-pixels having a polarity distribution with a second period of 2N, 2N sub-pixels within one of the second period being divided into a first region containing first to N-th sub-pixels and a second region containing (N+1)-th to 2N-th sub-pixels, and a polarity distribution of the sub-pixels in the first region being opposite to a polarity distribution of the sub-pixels in the second region.

8. The driving method as claimed in claim 7, wherein in a least common multiple region, a total number of first regions and second regions is L, in which L is an odd number, and N satisfies:

$$L=LCM(Q\times M,N)/N,$$

where L is an odd number, and LCM( ) represents a least common multiple operation.

9. The driving method as claimed in claim 7, wherein a polarity of P sub-pixels in a least common multiple region is opposite to a polarity of P sub-pixels in an adjacent least common multiple region, and the positive integer N and the odd number L are derived from a look-up table.

10. The driving method as claimed in claim 7, wherein the display device is a liquid crystal display device.

11. The display device as claimed in claim 7 wherein the polarity distribution are produced by data drivers.

12. The display device as claimed in claim 7, wherein the displayed pixels for $1\leq M<2^{K+1}$ are long-distance balanced, where K is a non-negative integer.

* * * * *